US008894315B2

(12) United States Patent
Dingert et al.

(10) Patent No.: US 8,894,315 B2
(45) Date of Patent: Nov. 25, 2014

(54) CLEANING DEVICE

(75) Inventors: Uwe Dingert, Absteinach (DE); Norbert Weis, Weinheim (DE)

(73) Assignee: Carl Freudenberg KG

( * ) Notice: Subject to any disclaimer, the term of this patent is extended or adjusted under 35 U.S.C. 154(b) by 203 days.

(21) Appl. No.: 13/518,106

(22) PCT Filed: Dec. 15, 2010

(86) PCT No.: PCT/EP2010/007637

§ 371 (c)(1),
(2), (4) Date: Jun. 21, 2012

(87) PCT Pub. No.: WO2011/085770

PCT Pub. Date: Jul. 21, 2011

(65) Prior Publication Data

US 2012/0255139 A1 Oct. 11, 2012

(30) Foreign Application Priority Data

Dec. 21, 2009 (DE) ..... 10 2009 060 008

(51) Int. Cl.

| | |
|---|---|
| ***A46B 11/00*** | (2006.01) |
| ***A47L 13/255*** | (2006.01) |
| ***A47L 13/146*** | (2006.01) |
| ***A47L 13/142*** | (2006.01) |
| ***A47L 13/58*** | (2006.01) |
| ***A47L 13/22*** | (2006.01) |
| ***A47L 13/258*** | (2006.01) |

(52) U.S. Cl.

CPC ..... *A47L 13/22* (2013.01); *A47L 13/255* (2013.01); *A47L 13/146* (2013.01); *A47L 13/142* (2013.01); *A47L 13/58* (2013.01); *A47L 13/258* (2013.01)

USPC ..... 401/268; 401/138; 401/139

(58) Field of Classification Search

USPC ..... 401/137–140, 268, 270; 15/228, 147.1, 15/149, 150

See application file for complete search history.

(56) References Cited

U.S. PATENT DOCUMENTS

| | | | | |
|---|---|---|---|---|
| 4,344,201 | A | 8/1982 | Trisolini | |
| 5,908,255 | A | 6/1999 | Branch | |
| 6,217,244 | B1 * | 4/2001 | Chen et al. | 401/140 |
| 6,726,388 | B1 | 4/2004 | Monahan | |
| 7,264,413 | B2 * | 9/2007 | Vosbikian et al. | 401/139 |
| 2003/0133739 | A1 | 7/2003 | Zhadanov et al. | |
| 2003/0167589 | A1 | 9/2003 | Dingert et al. | |
| 2004/0265037 | A1 | 12/2004 | Vosbikian et al. | |
| 2008/0010768 | A1 | 1/2008 | Lesley | |

FOREIGN PATENT DOCUMENTS

| | | | |
|---|---|---|---|
| DE | 102004 062336 | A1 | 6/2006 |
| WO | WO 2007/143471 | A2 | 12/2007 |

* cited by examiner

*Primary Examiner* — David Walczak
(74) *Attorney, Agent, or Firm* — Leydig, Voit & Mayer, Ltd.

(57) ABSTRACT

A cleaning device, comprising a handle, to which a cleaning body is fastened. A liquid reservoir is associated with the handle. The cleaning body has cleaning element that can be wrung out.

6 Claims, 9 Drawing Sheets

CLEANING DEVICE

CROSS-REFERENCE TO RELATED APPLICATIONS

This patent application is the national phase of PCT/EP2010/007637, filed Dec. 15, 2010, which claims the benefit of German Patent Application No. 10 2009 060 008.6, filed Dec. 21, 2009.

FIELD OF THE INVENTION

The invention relates to a cleaning device comprising a handle on which a cleaning body is mounted, a liquid reservoir being associated with the handle.

BACKGROUND OF THE INVENTION

Cleaning devices in which a liquid reservoir is associated with the handle are known from prior art. The cleaning body is equipped with cleaning elements that are configured as disposable items. Such devices are conceived for occasional cleaning, and they are distinguished by the fact that the cleaning elements must be changed relatively frequently and must be held in the hand for the exchange. These cleaning elements are not suitable for cleaning large areas or for taking up extensive contamination.

SUMMARY OF THE INVENTION

An object of the invention is to provide a cleaning device that has a long service life and is easy to clean.

To this end, the cleaning device has a handle to which a cleaning body is affixed. A liquid reservoir is associated with the handle and the cleaning body having a cleaning mechanism or element that can be wrung out. The wringable cleaning element is configured in such a manner that it remains on the cleaning body and therefore the cleaning device during the entire cleaning process. For cleaning, the cleaning element is guided over the floor to be cleaned, during which the floor can be moistened by emitting cleaning liquid from the liquid reservoir. When the cleaning element has absorbed the maximum amount of contamination, it can be rinsed out under running water or in some other manner and subsequently wrung out. The cleaning element remains on the cleaning device during the process, and it is not necessary to hold the cleaning element by hand. This enables particularly hygienic cleaning.

The liquid reservoir can be mounted externally on the handle. The liquid reservoir can be affixed removably to the handle so that it can be particularly easily removed for filling and then reattached.

The liquid reservoir can be arranged in the interior of the handle. In this configuration, a particularly compact device results which could scarcely be distinguished externally from conventional cleaning devices. For this reason, it is also possible to combine any desired cleaning body and cleaning element with such a handle.

The liquid reservoir can be actively connected to an actuation device. The actuation device can be arranged on a handgrip mounted at the upper end of the handle. The liquid can be metered out from the liquid reservoir in a particularly ergonomic manner in this way.

The liquid reservoir can be actively connected to a nozzle unit by which the liquid can be applied from the liquid reservoir to the floor to be cleaned. The nozzle unit is preferably constructed as a pump atomizer. Thereby the cleaning liquid can be distributed with a large throw distance and finely atomized.

A wringing device can be associated with the cleaning device. The wringing device is generally mounted on the handle. A variety of designs for a wringing device are conceivable, the design depending on the form of the cleaning element. Thus, the wringing device can be designed so that a wiping cover of a flat mop can be wrung out. It is also conceivable to arrange a wringing device for a fringe mop on the handle. It is advantageous that the functions of moistening, cleaning and wringing are combined in a single device, so that the cleaning work is particularly user-friendly.

The cleaning body can be a flat mop, and the cleaning element can be a wiping cover mounted on the flat mop. The wiping cover is preferably mounted detachably, for example by means of push buttons or Velcro fasteners, on the flat mop. Thereby the wiping cover can be introduced into a wringing device without having to be first detached from the flat mop. It is not necessary to hold the wiping cover by hand. In one advantageous configuration, the flat mop is foldable, so that the wiping cover hangs down in a loop shape from the flat mop. Thereby the wiping cover can be wrung out especially effectively in a wringing device.

The cleaning body can be a mop head, and the cleaning element can be formed by fringes that are mounted on the mop head. The mop head can also be configured in such a manner that the fringes can be wrung out by twisting the mop head. In another configuration, the fringes are wrung out in a pressing box.

BRIEF DESCRIPTION OF THE SEVERAL VIEWS OF THE DRAWINGS

Several exemplary embodiments of the cleaning device of the invention will be described below with reference to the Figures.

DETAILED DESCRIPTION OF THE INVENTION

Figure 1:
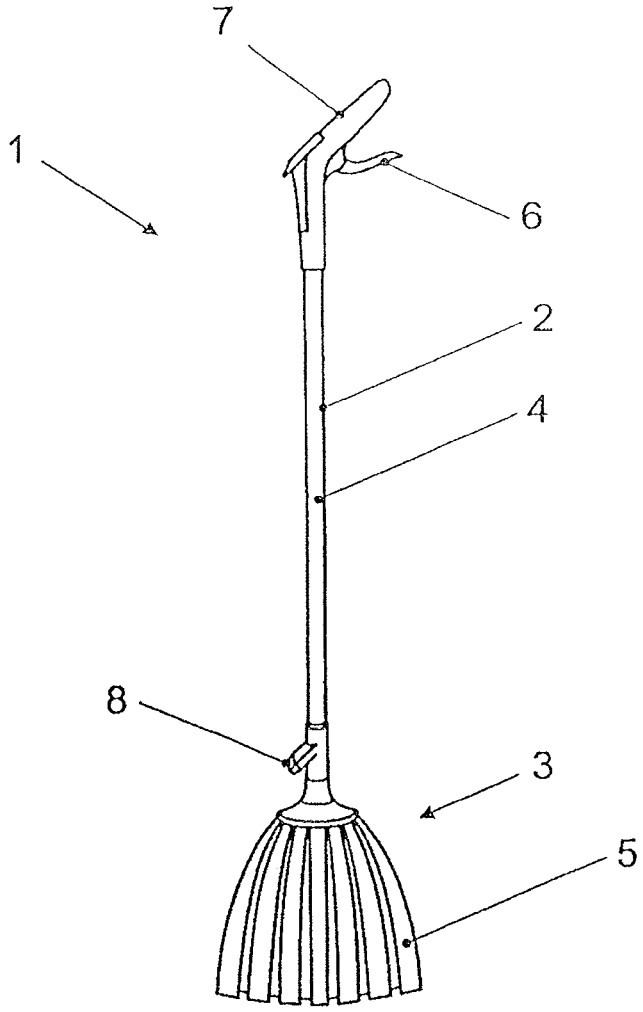
FIG. 1 is a schematic perspective view of an illustrative cleaning device according to the invention in the form of a fringe mop with a liquid reservoir in the handle.

The figures show a cleaning device 1, comprising a handle 2 to which a cleaning body 3 is fastened. A liquid reservoir 4 is associated with the handle 2 and the cleaning body 3 has a cleaning element 5 that can be wrung out. The liquid reservoir 4 is actively connected to an actuation device 6. The actuation device 6 is arranged on a handgrip 7. The handgrip 7 is mounted at the upper end of the handle 2. The liquid reservoir 4 is actively connected to a nozzle unit 8 by which the liquid can be applied from the liquid reservoir 4 to the floor to be cleaned.

FIG. 1 shows a cleaning device 1 constructed as a fringe mop. In such a cleaning device 1, the cleaning body 3 is a mop head, and the cleaning element 5 is formed by fringes fastened to the mop head. The mop head is mounted on the handle 2 in such a manner that neither the mop head nor the fringes can be removed during the cleaning work. For cleaning, the fringes are instead supplied to a wringing device 9. The liquid reservoir 4 is arranged in the interior of the handle 2 in this configuration.

Figure 2:
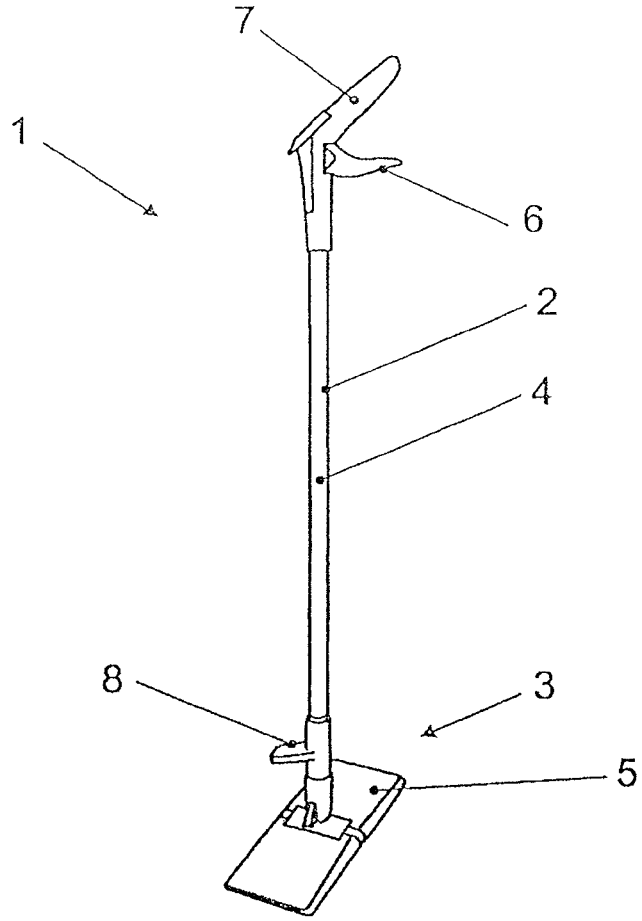
FIG. 2 is a schematic perspective view of an illustrative cleaning device according to the invention in the form of a flat mop with a liquid reservoir in the handle.

FIG. 2 shows a cleaning device 1 constructed as a flat mop. The cleaning body 3 in this cleaning device 1 is a wiping plate, and the cleaning element 5 is a wiping cover that is stretched onto the wiping plate. In this configuration, the wiping plate is foldable. Configurations with a rigid wiping plate are also conceivable, however. The wiping cover consists of a textile fabric and is used multiple times. The wiping cover can also be wrung out manually or in a wringing device. The liquid reservoir 4 is arranged in the interior of the handle 2 in this configuration.

Figure 3:
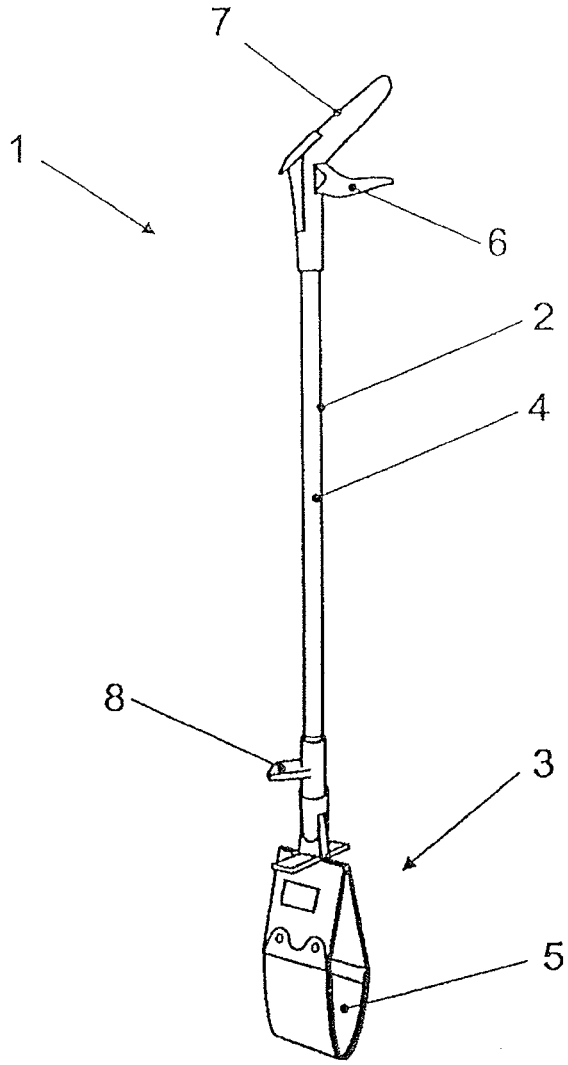
FIG. 3 is a schematic perspective view of an illustrative cleaning device according to the invention in the form of a flat mop with an affixed wiping cover.

FIG. 3 shows a cleaning device according to FIG. 2, the wiping cover being affixed to the wiping plate by means of push buttons in this configuration. In this configuration, the wiping cover is mounted on the wiping plate in such a manner that it hangs down in a loop shape from the wiping plate when the wiping plate is folded, and can thus be supplied to a wringing device 9 without the necessity of holding the wiping cover by hand. The liquid reservoir 4 is again arranged in the interior of the handle 2 in this configuration.

Figure 4:
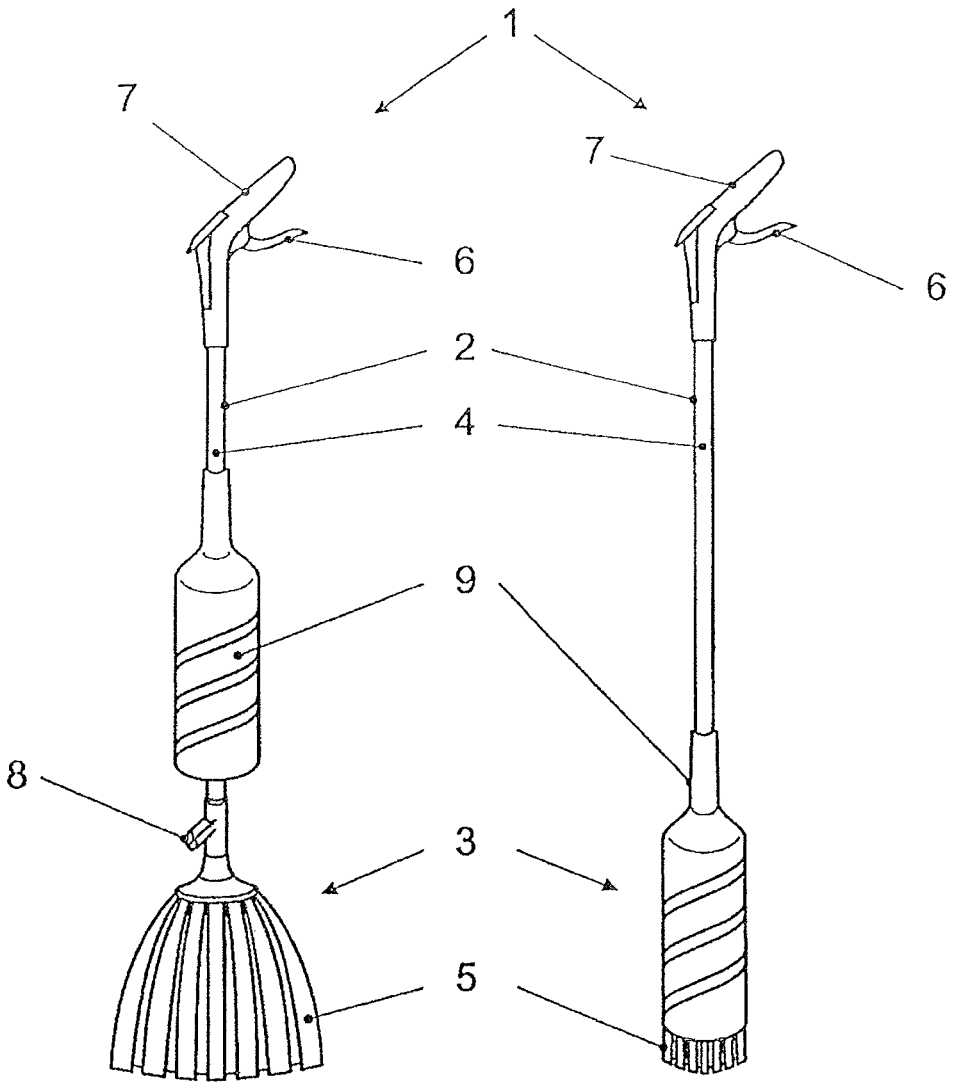
FIG. 4 is a schematic perspective view of an illustrative cleaning device according to the invention in the form of a fringe mop constructed as a twist mop.

FIG. 4 shows a cleaning device according to FIG. 1, i.e., a fringe mop. A wringing device 9 is associated with the cleaning device 1 in this configuration. The wringing device is arranged on the handle 2 and is constructed in such a manner that the fringes affixed to the mop are twisted during axial displacement of the ringing device 9 and thereby wrung out. The liquid reservoir 4 is arranged in the interior of the handle 2 in this configuration.

Figure 5:
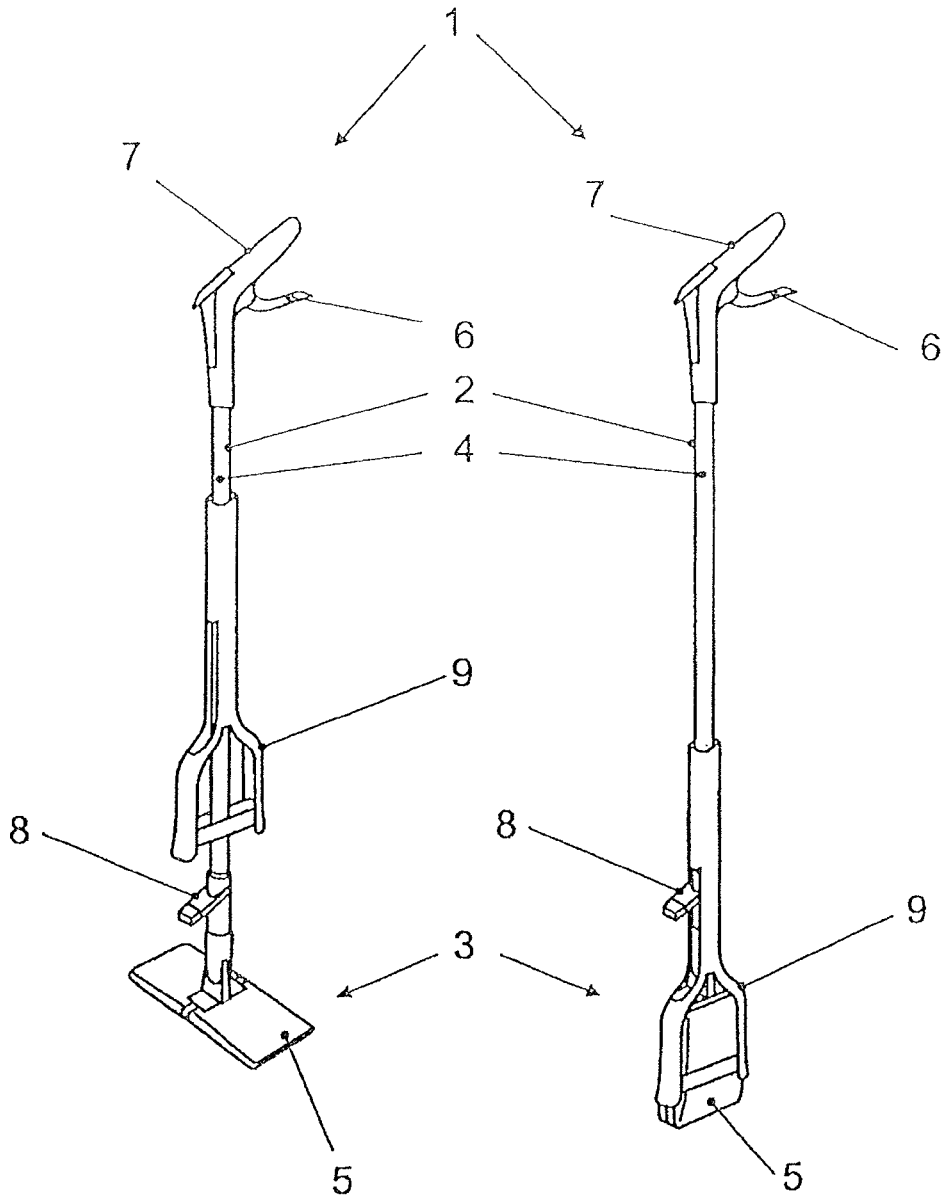
FIG. 5 includes schematic perspective views of an illustrative cleaning device according to the invention in the form of a flat mop constructed as a butterfly mop.

FIG. 5 shows a cleaning device 1 constructed as a flat mop. The cleaning body 3 in this cleaning device 1 is a wiping plate, and the cleaning element 5 is a wiping cover that is affixed to the wiping plate. In this configuration, the wiping cover is foldable, and the wiping cover is formed by an open-pore sponge with a coating of nonwoven fiber. A wringing device 9 is associated with the cleaning device 1 in this configuration. This wringing device is arranged on the handle 2 and is configured in such a manner that the foldable parts of the wiping cover are pressed together and thus wrung out. The liquid reservoir 4 is arranged in the interior of the handle 2 in this configuration.

Figure 6:
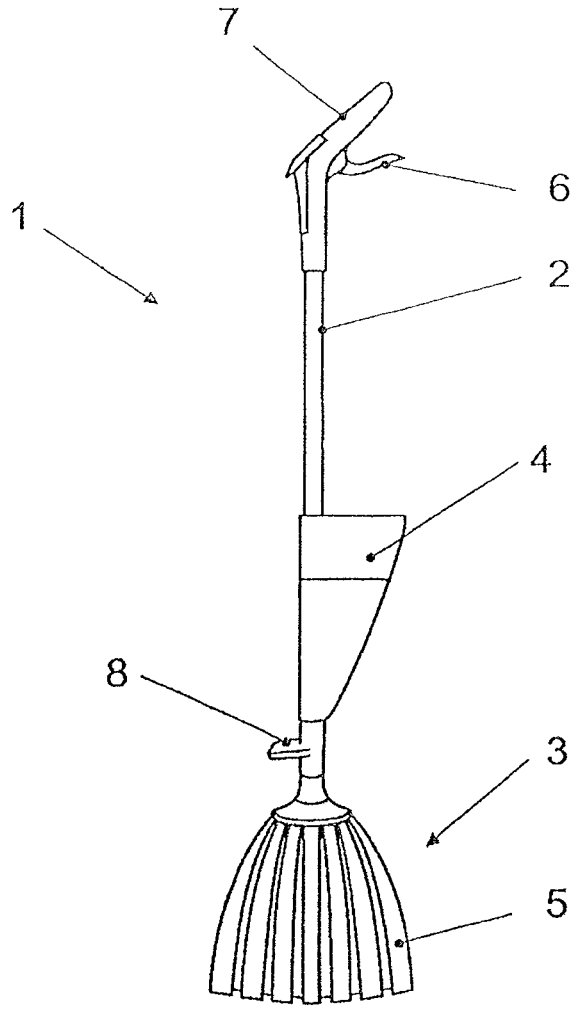
FIG. 6 is a schematic perspective view of an illustrative cleaning device according to the invention in the form of a fringe mop with a liquid reservoir arranged on the handle.

FIG. 6 shows a cleaning device according to FIG. 1, the liquid reservoir 4 being mounted externally on the handle 2 in this configuration. The liquid reservoir 4 is mounted on the handle 2 in such a manner that it is directly adjacent to the nozzle unit 8.

Figure 7:
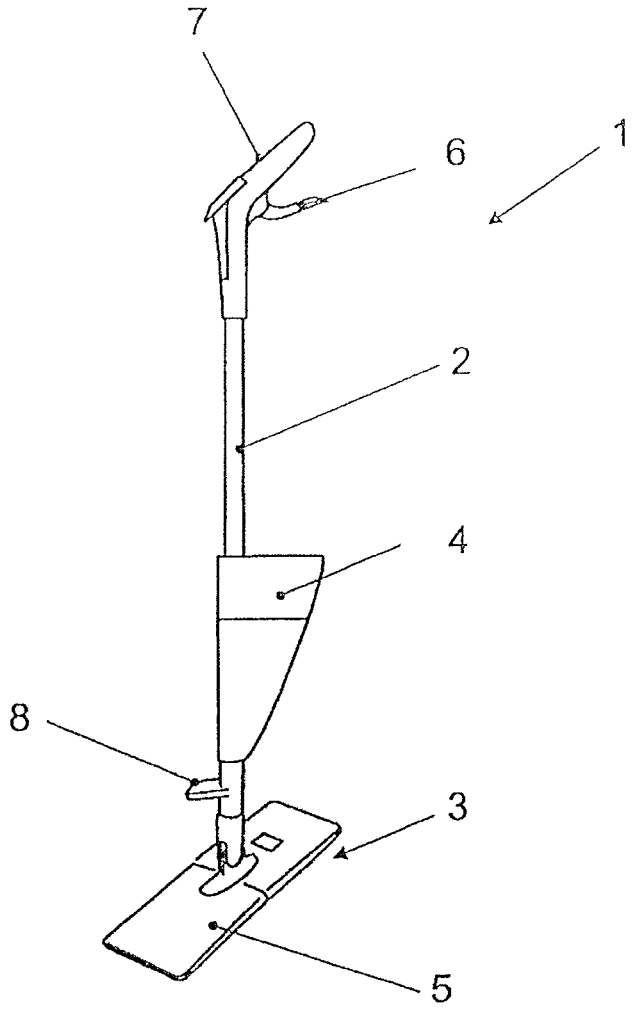
FIG. 7 is a schematic perspective view of an illustrative cleaning device according to the invention in the form of a flat mop with an external liquid reservoir.

FIG. 7 shows a cleaning device according to FIG. 2, the liquid reservoir 4 being mounted externally on the handle 2 in this configuration. The liquid reservoir 4 is mounted on the handle 2 in such a manner that it is directly adjacent to the nozzle unit 8.

Figure 8A:
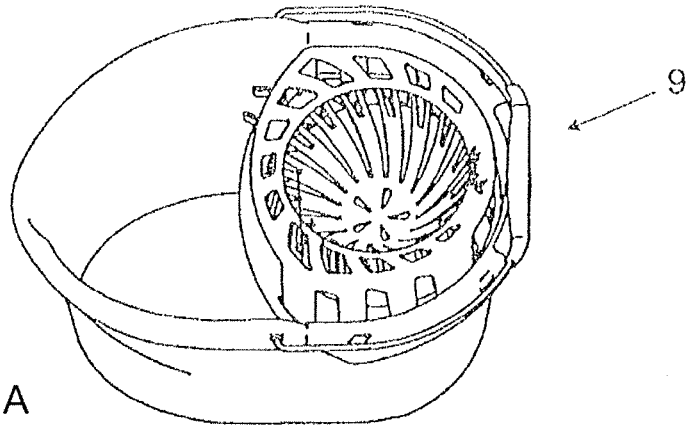
FIGS. 8A and 8B include a schematic top perspective view and a schematic side view of a wringing device for a fringe mop.
Figure 8B:
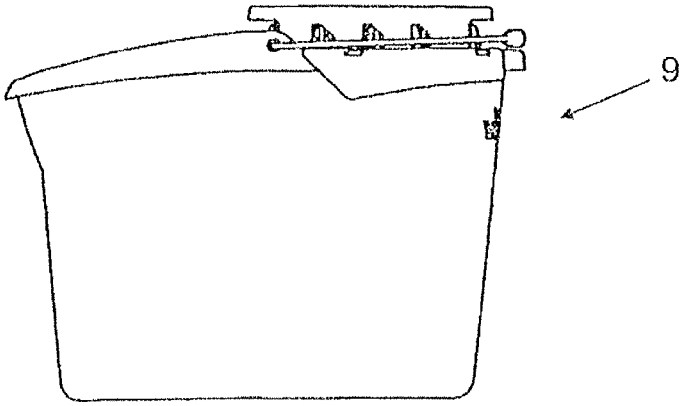

FIGS. 8A and B show a wringing device 9 for a cleaning device 1 according to FIG. 1 and for a cleaning device 1 according to FIG. 6. The wringing device 9 comprises a bucket and a wringing basket mounted inside the bucket. The cleaning device 1 and the cleaning device 9 form a mopping system.

Figure 9A:
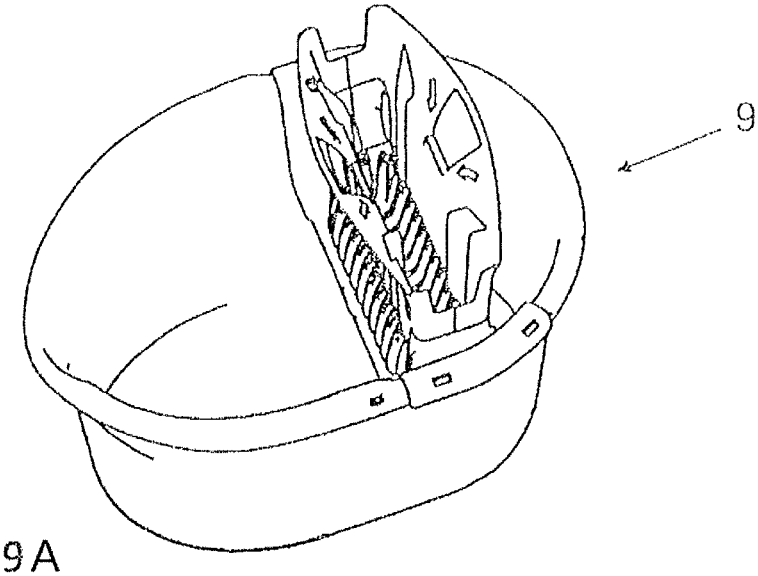
FIGS. 9A and 9B include a schematic top perspective view and a schematic side view of a wringing device for a flat mop.
Figure 9B:
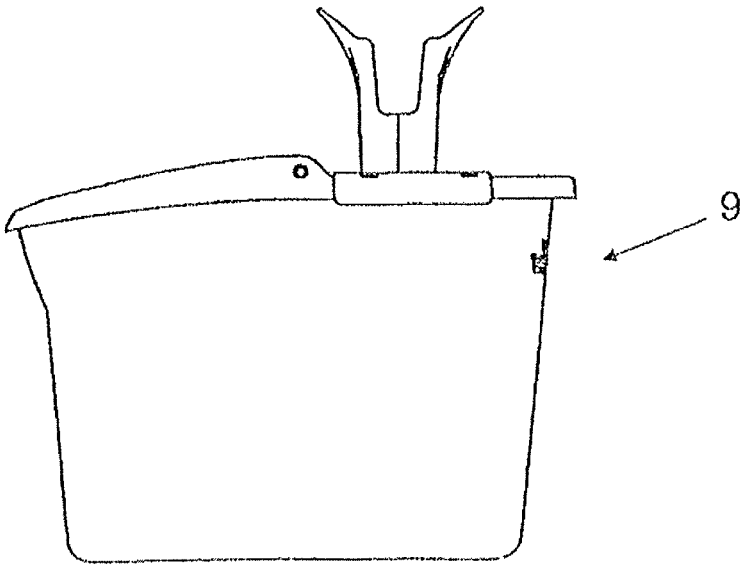

FIGS. 9A and B show a wringing device 9 for a cleaning device 1 according to FIG. 2 and for a cleaning device 1 according to FIG. 7. The wringing device 9 comprises a bucket and a wringing basket mounted inside the bucket. The cleaning device 1 and the wringing device 9 form a mopping system.

The invention claimed is:

1. A cleaning device comprising:

a handle to which a cleaning body is affixed, a liquid reservoir associated with the handle and the cleaning body having a cleaning element that can be wrung out;

wherein the cleaning body is a flat mop and the cleaning element comprises a wiping cover affixed to the flat mop and in contact with a lower surface of the flat mop during use and wherein the flat mop is foldable such that when the flat mop is in a folded position the wiping cover is attached at ends thereof to ends of the flat mop and has a central portion that hangs down in a loop shape and is thereby spaced from the lower surface of the flat mop for wringing from the flat mop.

2. A cleaning device according to claim 1, wherein the liquid reservoir is mounted externally on the handle.

3. A cleaning device according to claim 1, wherein the liquid reservoir is arranged in the interior of the handle.

4. A cleaning device according to claim 1, wherein the liquid reservoir is operatively connected to an actuation device, the actuation device being arranged on a handgrip, the handgrip being mounted at an upper end of the handle.

5. A cleaning device according to claim 1, wherein the liquid reservoir is operatively connected to a nozzle unit, wherein the nozzle unit is adapted to apply liquid to a floor surface.

6. A cleaning device according to claim 1, wherein a wringing device is associated with the cleaning device.

* * * * *